US005209308A

United States Patent [19]

Sasaki

[11] Patent Number: 5,209,308

[45] Date of Patent: May 11, 1993

[54] POWER DRIVEN SCREWDRIVER

[75] Inventor: Katsuhiko Sasaki, Anjo, Japan

[73] Assignee: Makita Corporation, Anjo, Japan

[21] Appl. No.: 958,183

[22] Filed: Oct. 8, 1992

[30] Foreign Application Priority Data

Oct. 8, 1991 [JP] Japan ..... 3-290803

[51] Int. Cl.[5] ..... B25B 23/00

[52] U.S. Cl. ..... 173/178; 81/429; 81/58.3; 192/56 R

[58] Field of Search ..... 173/176, 178, 211; 81/429, 58.3; 192/54, 56 R

[56] References Cited

U.S. PATENT DOCUMENTS

| | | | |
|---|---|---|---|
| 3,454,059 | 7/1969 | Sindelar | 81/429 |
| 4,630,512 | 12/1986 | Dürr | 81/429 |
| 4,647,260 | 3/1987 | O'Hara et al. | 81/429 |
| 4,691,786 | 9/1987 | Fujita et al. | 173/176 |
| 4,809,572 | 3/1989 | Sasaki . | |
| 5,054,588 | 10/1991 | Thorp et al. | 173/178 |

*Primary Examiner*—Douglas D. Watts
*Assistant Examiner*—Scott A. Smith
*Attorney, Agent, or Firm*—Dennison, Meserole, Pollack & Scheiner

[57] ABSTRACT

A power driven screwdriver includes a device interposed between a spindle and a housing for preventing rotation of the spindle. The device includes a first member and a second member. The first member is disposed on the spindle and is rotatable therewith. The second member is fixed to the housing and axially opposed to the first member. The first and the second members include a first conical surface and a second conical surface, respectively. The first and the second conical surfaces have central axes parallel to a central axis of the spindle, respectively, and are opposed to each other. At least one of the central axes of the first and the second conical surfaces is displaced from the central axis of the spindle. The first conical surface contacts the second surface when the spindle is positioned at a first position where a clutch mechanism disconnects the spindle from a motor.

7 Claims, 7 Drawing Sheets

POWER DRIVEN SCREWDRIVER

BACKGROUND OF THE INVENTION

1. Field of the Invention

The present invention relates to a power driven screwdriver, and particularly to a power driven screwdriver having a device for preventing rotation of a spindle during fitting operation of a screw on a driver bit mounted on the spindle.

2. Description of the Prior Art

In a power driven screwdriver, for driving a screw by the power driven screwdriver, the screw is fitted on a driver bit and is driven by rotating the driver bit through a spindle. To ensure safe fitting operation of the screw on the driver bit, it has been proposed to provide a device for preventing rotation of the spindle during such fitting operation of the screw.

The spindle is driven by a motor through a clutch mechanism such as a claw clutch. The spindle is slidably movable in an axial direction between two positions, one for disengagement of the clutch mechanism and the other for engagement of the clutch mechanism. A spring is provided to normally bias the spindle in a direction to the position for disengagement of the clutch mechanism. When the clutch mechanism has been disengaged, the spindle which has been driven by the motor through the clutch mechanism tends to continuously rotate by a frictional force of the spring against the spindle.

Thus, the device for preventing rotation of the spindle is provided in the screwdriver and conventionally, the device includes an O-ring which is Positioned coaxially with the spindle and which may contact a part of the spindle with the aid of the biasing force of the spring when the clutch mechanism has been disengaged. The O-ring provides a frictional force against the rotation of the spindle.

However, the conventional device for preventing rotation of the spindle utilizing the O-ring cannot be reliably operated because of variations in performance or quality in manufacturing O-rings.

SUMMARY OF THE INVENTION

It is, accordingly, an object of the present invention to provide a power driven screwdriver including a device for preventing rotation of a spindle which is simple in construction and which can reliably prevent rotation of the spindle.

According to the present invention, there is provided a power driven screwdriver comprising:

a housing;

a motor mounted within the housing;

a spindle rotatably mounted within the housing for engagement with a driver bit for driving a screw, the spindle being axially movable relative to the housing between a first position and a second position;

biasing device for normally biasing the spindle toward the first position;

a drive member rotatably driven by the motor;

a clutch mechanism interposed between the spindle and the drive member, the clutch mechanism disconnecting the drive member from the spindle when the spindle is positioned at the first position, and the clutch mechanism permitting transmission of rotation of the drive member to the spindle when the spindle is positioned at the second position; and a device interposed between the spindle and the housing for preventing rotation of the spindle, the device including a first member and a second member, the first member being disposed on the spindle and rotatable therewith, the second member being fixed to the housing and axially opposed to the first member, the first and the second members including a first conical surface and a second conical surface, respectively, the first and the second conical surfaces having central axes parallel to a central axis of the spindle, respectively, and being opposed to each other, at least one of the central axes of the first and the second conical surfaces being displaced from the central axis of the spindle, and the first conical surface contacting the second surface when the spindle is positioned at the first position.

The invention will become more fully apparent from the claims and the description as it proceeds in connection with the drawings.

DETAILED DESCRIPTION OF THE PREFERRED EMBODIMENT

Figure 1:
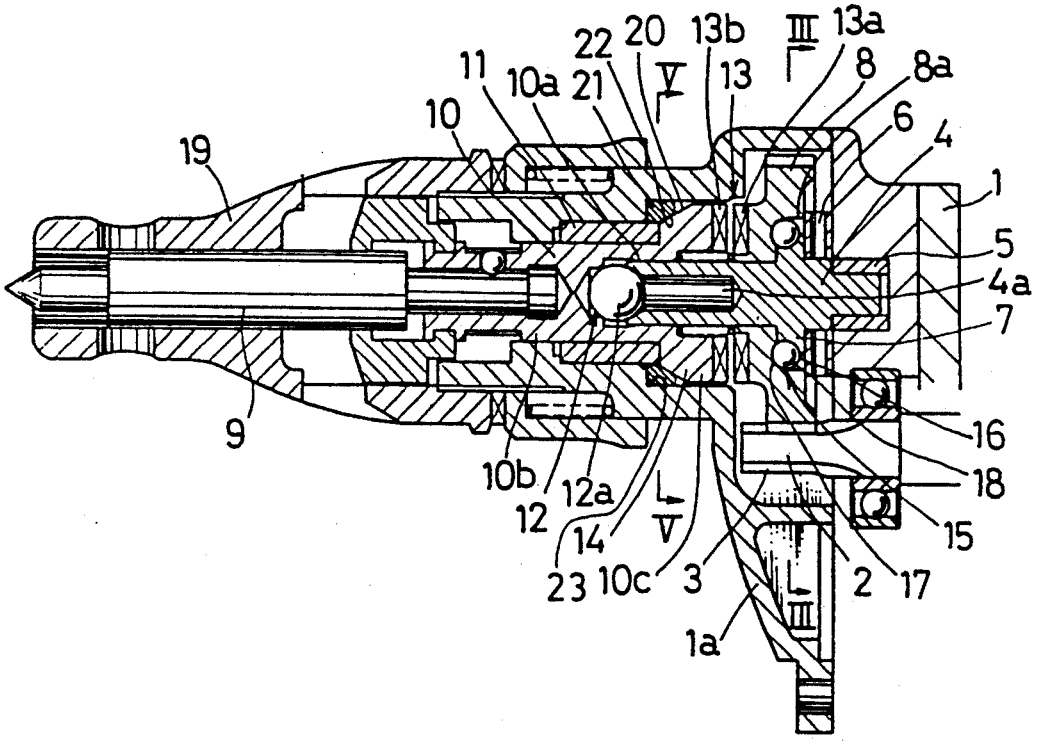
FIG. 1 is a vertical sectional view of a part of a power driven screwdriver according to an embodiment of the present invention.
Figure 2:
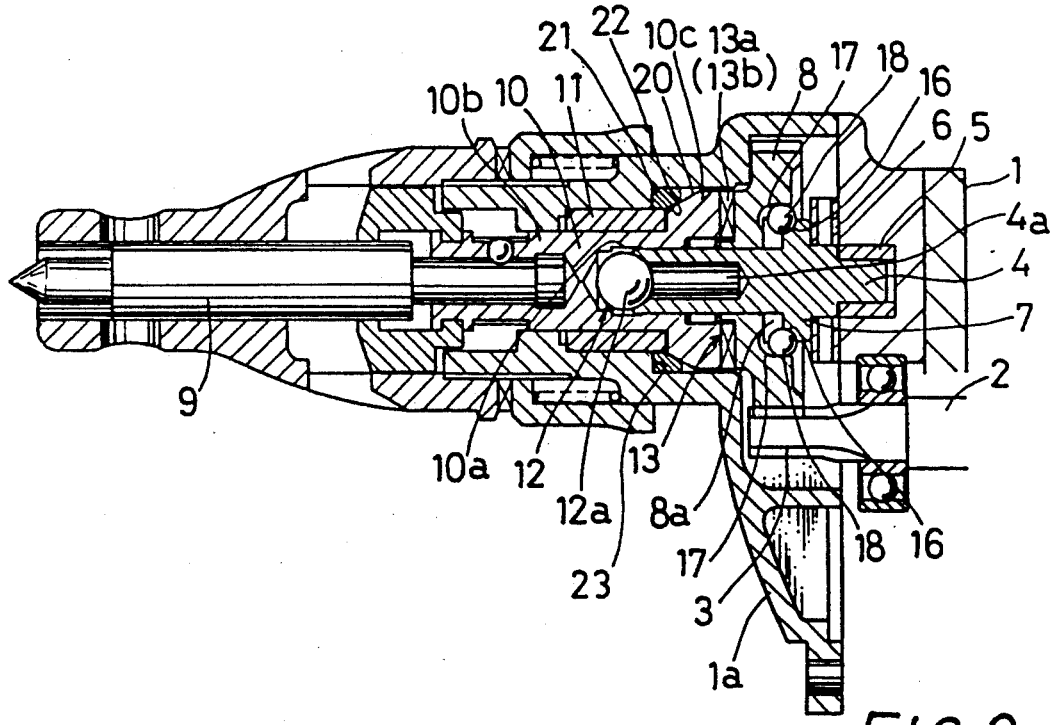
FIG. 2 is a view similar to FIG. 1 but showing a different operation.
Figure 3:
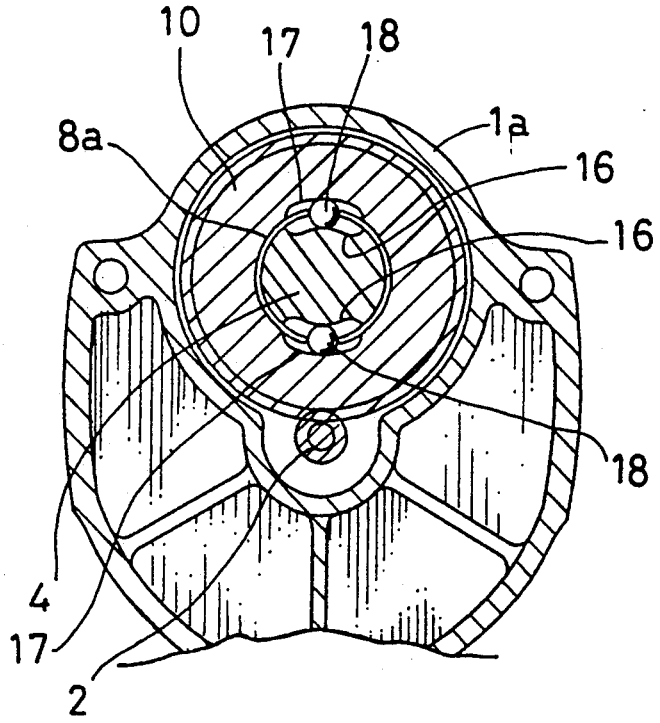
FIG. 3 is a sectional view taken along line III—III in FIG. 1.

Referring to FIG. 1, there is shown a sectional view of a part of a power driven screwdriver according to the present invention. The power driven screwdriver includes a motor housing 1 which accommodates a motor (not shown) having a motor shaft 2. The motor shaft 2 extends into a gear housing 1*a* mounted on one end of the motor housing 1. A pinion 3 is integrally formed with the motor shaft 2.

A cam shaft 4 is disposed within the gear housing 1*a*. The rear end of the cam shaft 4 is rotatably supported by the gear housing 1*a* through a metal bearing 5 and a thrust bearing 6. The forward end of the cam shaft 4 is rotatably supported by a spindle 10 through its axial hole 10*a* as will be hereinafter explained. The cam shaft 4 includes an annular flange 7 which extends outwardly from the cam shaft 4 and which is born against the thrust bearing 6. A gear 8 is rotatably and axially movably mounted on the cam shaft 4. On the rear side of the gear 8, a recess 8a is formed for slidably receiving the flange 7.

The spindle 10 is rotatably supported by the gear housing 1a through a metal bearing 11 and is disposed on the same axis as the cam shaft 4. The spindle 10 is permitted to move in an axial direction to some extent. A driver bit 9 is detachably mounted on the forward end of the spindle 10. A frictional clutch mechanism 12 is provided between the bottom of the axial hole 10a of the spindle 10 and the forward end of the cam shaft 4 inserted into the axial hole 10a. The frictional clutch mechanism 12 includes a steel ball 12a which abuts on the bottom of the axial hole 10a of the spindle 10 on one side and which is partly received by an axial hole 4a formed on the forward end of the cam shaft 4.

The spindle 10 includes a first portion 10a and a second Portion 10b in the axial direction. The first portion 10a has relatively small diameter and is supported by the metal bearing 11. The second portion 10b is disposed at the rear end of the spindle 10 and has relatively large diameter.

A claw clutch mechanism 13 is provided between the gear 8 and the spindle 10 and includes a first clutch member 13a and a second clutch member 13b for engagement with each other. The first and the second clutch members 13a and 13b are formed on the front surface of the gear 8 and the end surface of the second portion 10b of the spindle 10 which are disposed in opposed relationship with each other. A spring 14 is interposed between the gear 8 and the spindle 10 for normally biasing the first and the second clutch members 13a and 13b in the disengaging direction.

Figure 4A:
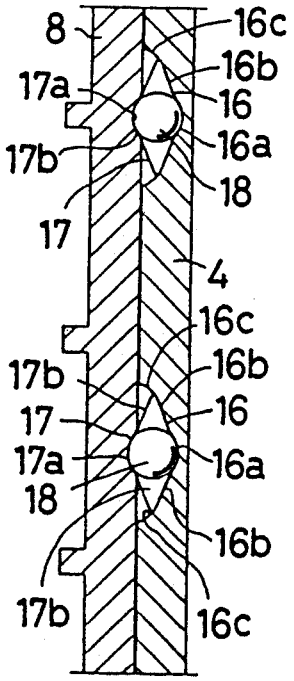
FIGS. 4(*a*), 4(*b*) and 4(*c*) are views illustrating various operations of a cam mechanism in developed form.
Figure 4B:
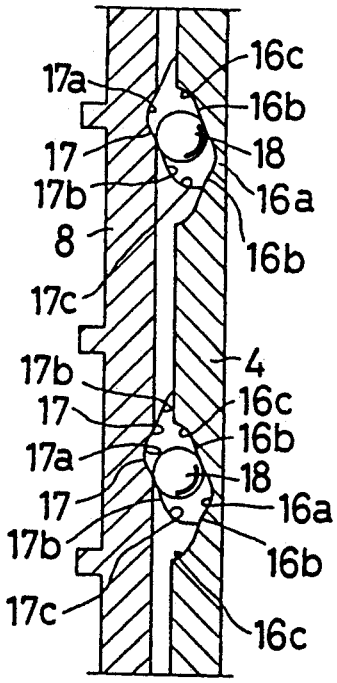
Figure 4C:
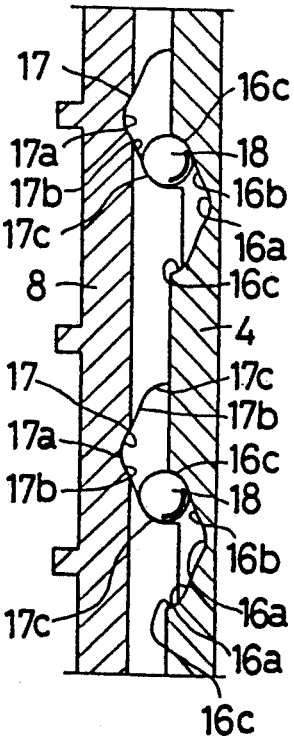

A cam mechanism 15 is provided between the flange 7 of the cam shaft 4 and the gear 8. As shown in FIGS. 4(a), 4(b) and 4(c), the cam mechanism 15 includes a pair of engaging recesses 16 having substantially V-shaped configuration and formed on the peripheral portion of the front surface of the flange 7 of the cam shaft 4 at a position diametrically opposed to each other, a pair of control recesses 17 having substantially V-shaped configuration and formed on the peripheral portion of the bottom of the recess 8a of the gear 8 in opposed relationship with the engaging recesses 16, respectively, and a pair of control balls 18 made of steel and engaged between the engaging recesses 16 and their corresponding control recesses 17, respectively, for transmitting rotation of the gear 8 to the cam shaft 4.

Each of the engaging recesses 16 includes a first engaging surface 16a, a second engaging surface 16b and a third engaging surface 16c formed in series in a circumferential direction. The first engaging surface 16a is positioned at the bottom of the engaging recess 16 and is of substantially circular arc configuration in section. The second engaging surface 16b extends obliquely outwardly from the first engaging surface 16a. The third engaging surface 16c extends from the outer end of the second engaging surface 16b and is of substantially circular arc configuration in section. As with the engaging recesses 16, each of the control recesses 17 includes a first control surface 17a, a second control surface 17b and a third control surface 17c formed in series in a circumferential direction. The first control surface 17a is positioned at the bottom of the control recess 17 and is of substantially circular arc configuration in section. The second control surface 17b extends obliquely outwardly from the first control surface 17a. The third control surface 17c extends from the outer end of the second control surface 17b and is of substantially circular arc configuration in section.

With the cam mechanism 15 as described above, when each of the control balls 18 is in engagement with the first engaging surface 16a of the corresponding engaging recess 16 and is in engagement with the first control surface 17a of the corresponding control recess 17, the first and the second clutch members 13a and 13b of the claw clutch mechanism 13 are separated not to engage with each other. When each of the control balls 18 is moved to engage the second engaging surface 16b and the second control surface 17b, the first and the second clutch members 13a and 13b are brought to engage with each other to some extent. When each of the control balls 18 is further moved to engage the third engaging surface 16c and the third control surface 17c, the first and the second clutch members 13a and 13b are brought to sufficiently engage with each other.

The driver bit 9 is inserted into a cylindrical stopper sleeve 19 which is threadably engaged with the forward end of the gear housing 1a, so that the position of the stopper sleeve 19 relative to the gear housing 1a can be adjusted to determine the protruding distance of the driver bit 9 from the forward end of the stopper sleeve 19 according to the amount of driving of a screw to be obtained.

Figure 5:
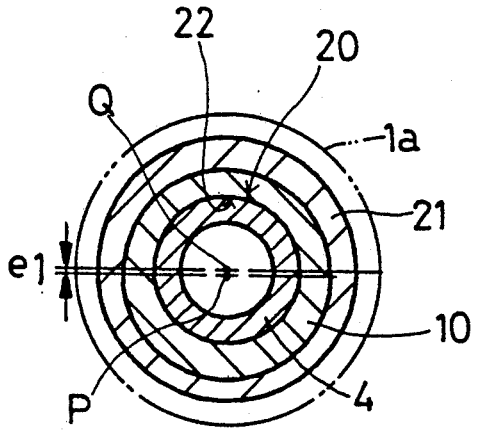
FIG. 5 is a sectional view taken along line V—V in FIG. 1.
Figure 6:
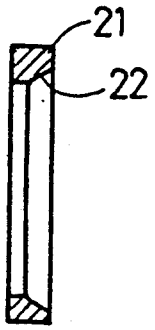
FIG. 6 is an enlarged sectional view of a ring for preventing rotation of a spindle.
Figure 7:
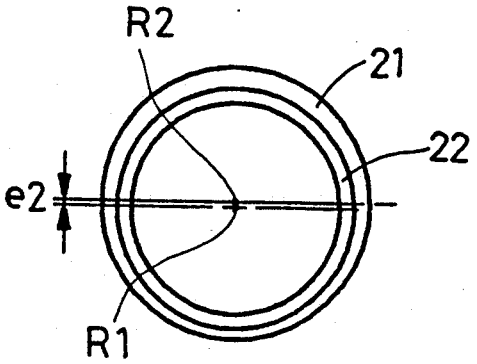
FIG. 7 is a rear view of FIG. 6.
Figure 8:
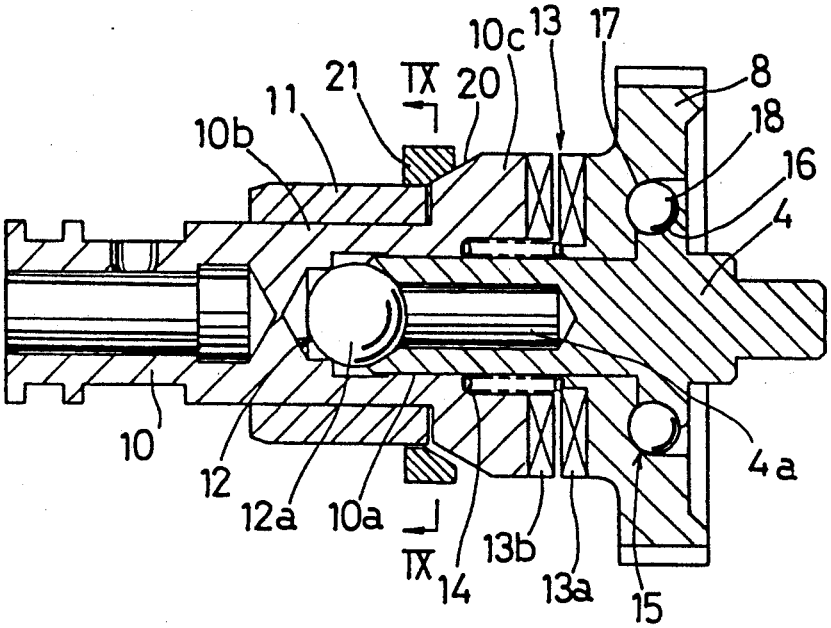
FIG. 8 is a sectional view illustrating relationship between a first conical surface and a second conical surface in a first operational situation.
Figure 9:
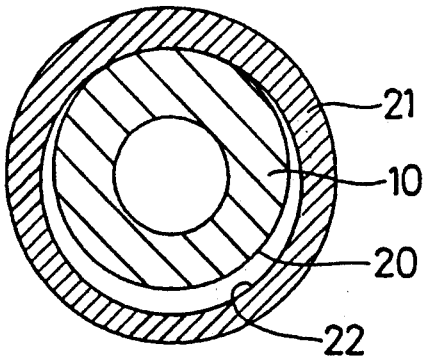
FIG. 9 is a sectional view taken along line IX—IX in FIG. 8.
Figure 10:
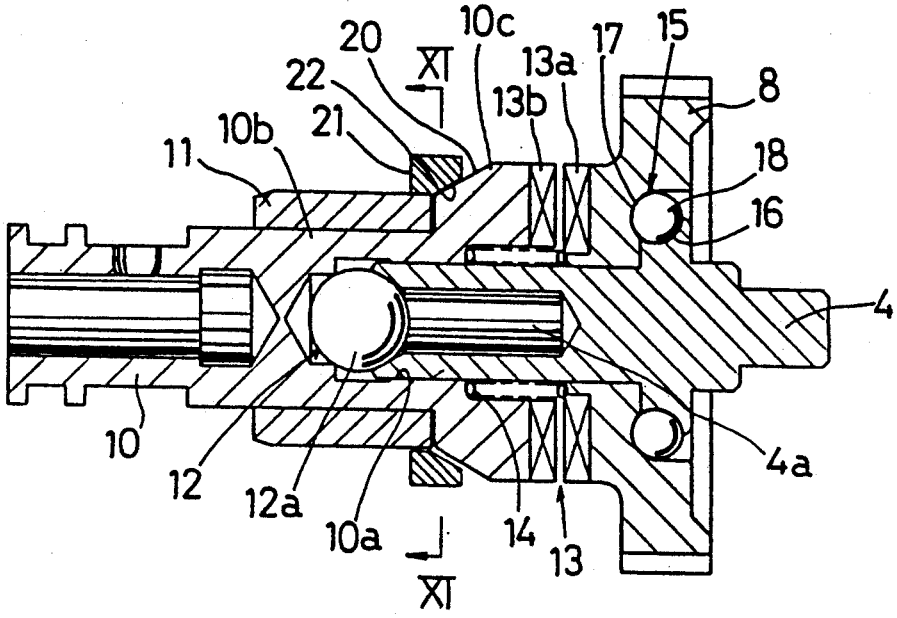
FIG. 10 is a view similar to FIG. 8 but showing a second operational situation.
Figure 11:
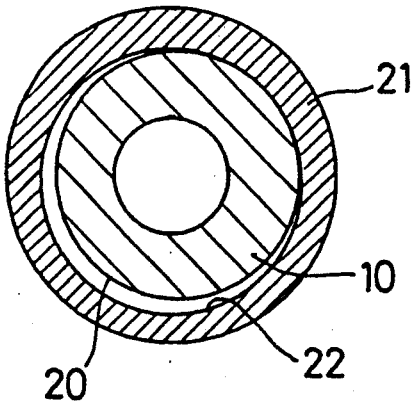
FIG. 11 is sectional view taken along line XI—XI in FIG. 10.
Figure 12:
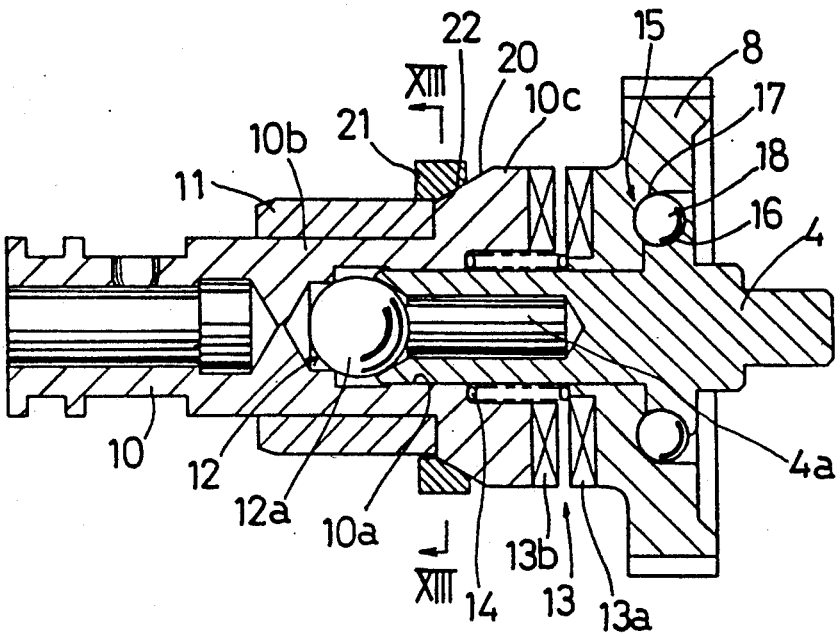
FIG. 12 is a view similar to FIG. 8 but showing a third operational situation.
Figure 13:
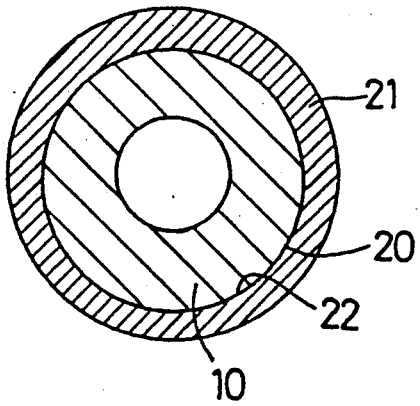
FIG. 13 is a sectional view taken along line XIII—XIII in FIG. 12.

The second portion 10c of the spindle 10 includes a first conical surface 20 on its outer surface. As shown in FIG. 5, a central axis P of the first conical surface 20 is displaced from a central axis Q of the spindle 10 by a short distance e1. A ring 21 shown in FIG. 6 is fixedly received within a recess 23 formed between the stepped inner wall of the gear housing 1a and the rear portion of the metal bearing 11. The ring 21 is made of resilient material such as a rubber and includes a second conical surface 22. The second conical surface 22 has the same inclination angle with the first conical surface 20 of the spindle 10 and is opposed to the first conical surface 20 in an axial direction. As shown in FIG. 7, a central axis R of the second conical surface 22 is displaced from a central axis R1 of the outer surface of the ring 21 by a distance e2. In this embodiment, the distance e2 is equal to the distance e1. The central axis R1 of outer surface of the ring 21 coincides with the central axis Q of the spindle 10 in the mounting situation of the ring 21 as shown in FIG. 1. Thus, both the central axis P of the first conical surface 20 and the central axis R1 of the second conical surface 22 are displaced from the central axis Q of the spindle 10 by the same distance. The position of the ring 21 is determined in such a manner that the first conical surface 20 may contact the second conical surface 22 when the first and the second clutch members 13a and 13b of the claw clutch mechanism 13 have been completely disengaged.

The operation of the above embodiment will now be explained.

Firstly, the position of the stopper sleeve 19 is adjusted according to the amount of driving of the screw to be driven as described above. The screw is thereafter fitted on the forward end of the driver bit 9 and the screwdriver is positioned for abutment of the screw on a work to be screwed. At this stage, as shown in FIG. 4(a), each of the control balls 18 of the cam mechanism 15 engages the first engaging surface 16a of the corresponding engaging recess 16 as well as the control surface 17a of the corresponding control recess 17, and the first and the second clutch members 13a and 13b of the claw clutch mechanism 13 are disengaged from each other. Therefore, when the motor has been started to rotate the gear 8 through the pinion 3 of the motor shaft 2, the rotation of the gear 8 is transmitted to the cam shaft 4 through the cam mechanism 15 but is not transmitted to the spindle 10 or to the driver bit 9.

When the screw fitted on the driver bit 9 has been pressed on the work by forcing the screw driver toward the work, the spindle 10 is moved rearwardly toward the gear 8 to some extent, so that the rotation of the cam shaft 4 is transmitted to the spindle 10 through the frictional clutch mechanism 12. As the load applied from the spindle 10 to the cam shaft 4 becomes larger, the gear 8 rotates relative to the flange 7 of the cam shaft 4 in such a manner that each of the control balls 18 of the cam mechanism 15 moves from the first engaging surface 16*a* of the corresponding engaging recess 16 to the second engaging recess 16*b* passing over a ridge formed therebetween and also moves from the first control surface 17*a* of the corresponding control recess 17 to the second control surface 17*b* passing over a ridge formed therebetween as shown in FIG. 4(*b*) and that each of the control balls 18 thereafter moves from the second engaging surface 16*b* to the third engaging surface 16*c* and also moves from the second control surface 17*b* to the third control surface 17*c* as shown in FIG. 4(*c*). According to such movement of the control balls 18, the gear 8 is moved forwardly relative to the flange 7 against the biasing force of the spring 14, so that the first and the second clutch members 13*a* and 13*b* are sufficiently engaged with each other. The spindle 10 is therefore rotated by a greater torque by the gear 8 through the claw clutch mechanism 13 so as to further drive the screw. The forward movement of the screwdriver is stopped when the forward end of the stopper sleeve 19 abuts on the work. At this stage, since no substantial force is applied to the driver bit 9, the load from the spindle 4 applied to the cam shaft 4 is reduced. Thus, the torque transmitted from the cam shaft 4 to the spindle 10 through the frictional clutch mechanism 12 is reduced. Such reduction of torque causes movement of engaging position of each of the control balls 18 from the third engaging surface 16*c* to the first engaging surface 16*a* via the second engaging surface 16*b* as well as the movement from the third control surface 17*c* to the first control surface 17*a* via the second control surface 17*b* by the biasing force of the spring 14. Thus, the gear 8 is moved in a direction toward the flange 7 of the cam shaft 4, and the first and the second clutch members 13*a* and 13*b* of the claw clutch mechanism 13 are completely disengaged.

At this stage, the rotation of the cam shaft 4 is no longer transmitted to the spindle 10 and the driving operation of the screw is completed. However, the spindle 10 is still rotating at relatively low speed in spite of the frictional force caused by the spring 14.

As the first and the second clutch members 13*a* and 13*b* are thus disengaged, the spindle 10 is moved forwardly by the biasing force of the spring 14, and consequently the first conical surface 20 of the second portion 10*c* of the spindle 10 contacts the second conical surface 22 of the ring 21. A frictional force between the first and the second conical surfaces 20 and 22 is thus produced for preventing rotation of the spindle 10. Since the central axes P and R1 of the first and the second conical surfaces 20 and 22 are displaced from the central axis Q of the spindle 10, such frictional contact between the first and the second conical surfaces 20 and 22 takes two different phases. One of these phases is the frictional contact accompanying a thrust of a part of the first conical surface 20 into the second conical surface 22 which may be resiliently deformed. The other is the frictional contact accompanying the contact throughout the peripheries of the first and the second conical surfaces 20 and 22 when the central axis P of the first conical surface 20 has been positioned to coincide with the central axis R1 of the second conical surface 22. Thus, the spindle 10 can be reliably prevented from rotation by such two phases of contact which may be alternately produced.

Further, with the above embodiment, as the force applied from the work to the driver bit 9 is reduced and the load from the spindle 4 applied to the cam shaft 4 is reduced, the torque transmitted from the cam shaft 4 to the spindle 10 through the frictional clutch mechanism 12 is reduced. According to such reduction of torque, the engaging position of each of the control balls 18 is smoothly moved from the third engaging surface 16*c* to the first engaging surface 16*a* via the second engaging surface 16*b* and is also smoothly moved from the third control surface 17*c* to the first control surface 17*a* via the second control surface 17*b* by the biasing force of the spring 14. Once each of the control balls 18 has been engaged with the engaging surface 16*a* and the control surface 17*a*, it may not be moved from the first engaging surface 16*a* to the second engaging surface 16*b* and may not be moved from the first control surface 17*a* to the second control surface 17*b* unless a considerable axial force is applied to the spindle 10 so as to provide such torque to the cam shaft 4 through the frictional clutch mechanism 12 that permits movement of each of the control balls 18 from the first engaging surface 16*a* to the second engaging surface 16*b* passing over the ridge formed therebetween and also that permits movement from the first control surface 17*a* to the second control surface 17*b* passing over the ridge formed therebetween. Therefore, the first and the second clutch members 13*a* and 13*b* are quickly disengaged and the disengaging position is reliably maintained. Further unpleasant clanging sounds which may accompany the disengaging operation is reduced.

Additionally, after completion of the first screwing operation, a further driving operation of the screw can be performed for further tightening the screw by applying to the spindle 10 an axial force so as to provide sufficient torque to the cam shaft 4 through the frictional clutch mechanism 12 for permitting movement of each of the control balls 18 from the first engaging surface 16*a* to the second engaging surface 16*b* passing over the ridge formed therebetween and for also permitting movement from the first control surface 17*a* to the second control surface 17*b* passing over the ridge formed therebetween.

Although in the above embodiment, both the central axes P and R1 of the first and the second conical surfaces 20 and 22 are displaced from the central axis Q of the spindle 10, the similar effect can be obtained by displacing either one of the central axes P and R1 of the first and the second conical surfaces 20 and 22 from the central axis Q of the spindle 10.

Further, although in the above embodiment, the first conical surface 20 is formed on the outer surface of the spindle, the first conical surface 20 may be formed on a different member which is mounted on the spindle 10. Additionally, although a member having the second conical surface 22 is formed as the ring 21, such member may have a different shape other than a ring.

While the invention has been described with reference to a preferred embodiment thereof, it is to be understood that modifications or variations may be easily made without departing from the scope of the present invention which is defined by the appended claims.

What is claimed is:

1. A power driven screwdriver comprising:

a housing:

a motor mounted within said housing:

a spindle rotatably mounted within said housing for engagement with a driver bit for driving a screw, said spindle being axially movable relative to said housing between a first position and a second position;

biasing means for normally biasing said spindle toward said first position;

a drive member rotatably driven by said motor;

a clutch mechanism interposed between said spindle and said drive member, said clutch mechanism disconnecting said drive member from said spindle when said spindle is positioned at said first position, and said clutch mechanism permitting transmission of rotation of said drive member to said spindle when said spindle is positioned at said second position; and a device interposed between said spindle and said housing for preventing rotation of said spindle, said device including a first member and a second member, said first member being disposed on said spindle and rotatable therewith, said second member being fixed to said housing and axially opposed to said first member, said first and second members including a first conical surface and a second conical surface, respectively, said first and second conical surfaces having central axes parallel to a central axis of said spindle, respectively, and being opposed to each other, at least one of the central axes of said first and second conical surfaces being displaced from the central axis of said spindle, and said first conical surface contacting said second surface when said spindle is positioned at said first position.

2. The power driven screwdriver as defined in claim 1 wherein both central axes of said first and second conical surfaces are displaced from the central axis of said spindle.

3. The power driven screwdriver as defined in claim 1 wherein said second member is made of resilient material.

4. The power driven screwdriver as defined in claim 3 wherein said second member is of annular configuration and is fixed to an inner wall of said housing so as to surround said spindle, and said second member includes said second conical surface on its inner peripheral surface.

5. The power driven screwdriver as defined in claim 3 wherein said second member is made of rubber.

6. The power driven screwdriver as defined in claim 1 wherein said first and second conical surfaces have the same inclination angle.

7. The power driven screwdriver as defined in claim 1 wherein said first and second conical surfaces are oriented inwardly and outwardly, respectively.

* * * * *